US007413410B2

(12) United States Patent
Shahin et al.

(10) Patent No.: US 7,413,410 B2
(45) Date of Patent: Aug. 19, 2008

(54) CEILING FAN BLADE

(75) Inventors: Nabil Shahin, Cordova, TN (US); Edwin T. Koehler, Cordova, TN (US)

(73) Assignee: Hunter Fan Company, Memphis, TN (US)

( * ) Notice: Subject to any disclaimer, the term of this patent is extended or adjusted under 35 U.S.C. 154(b) by 559 days.

(21) Appl. No.: 11/085,286

(22) Filed: Mar. 21, 2005

(65) Prior Publication Data

US 2006/0210401 A1 Sep. 21, 2006

(51) Int. Cl.
*F04D 29/38* (2006.01)

(52) U.S. Cl. ..... 416/238; 416/243

(58) Field of Classification Search ..... 416/223 R, 416/238, 242, 243, DIG. 2, DIG. 5
See application file for complete search history.

(56) References Cited

U.S. PATENT DOCUMENTS

| | | | | |
|---|---|---|---|---|
| 4,782,213 | A | 11/1988 | Teal | 219/372 |
| 4,892,460 | A | 1/1990 | Volk | 416/62 |
| 4,974,633 | A | 12/1990 | Hickey | 137/561 |
| 5,033,113 | A | 7/1991 | Wang | 455/603 |
| 5,244,349 | A | 9/1993 | Wang | 416/231 |
| 6,039,541 | A | 3/2000 | Parker et al. | 416/223 |
| 6,116,856 | A | 9/2000 | Karadgy et al. | 416/203 |
| 6,341,940 | B1 | 1/2002 | Giribaldi | 416/189 |
| 6,659,721 | B1 * | 12/2003 | Parker et al. | 416/5 |
| 6,719,532 | B2 | 4/2004 | Bird | 416/210 |
| 6,719,533 | B2 | 4/2004 | Bird | 416/210 |
| 6,733,241 | B2 | 5/2004 | Bird | 416/238 |

FOREIGN PATENT DOCUMENTS

| | | |
|---|---|---|
| GB | 676406 | 7/1952 |
| WO | WO 9207192 | 4/1992 |

* cited by examiner

*Primary Examiner*—Edward Look
*Assistant Examiner*—Dwayne J White
(74) *Attorney, Agent, or Firm*—Baker Donelson et al.

(57) ABSTRACT

A ceiling fan blade is disclosed that is twisted rather than flat and has a graduated dihedral. The dihedral is provided for a wider distribution of divergence of air in the space beneath the fan. The blade (10) is demarked to have three sections which include a mounting section (11) and two airflow sections (12) and (13). The two airflow sections (12) and (13) are twisted with the rate of twist from the root end to the tip end being nonuniform. The twist or ratio of the degree increase in the angle of attack over each inch in length deceases from root end to the tip end.

17 Claims, 3 Drawing Sheets

CEILING FAN BLADE

TECHNICAL FIELD

This invention relates generally to ceiling fans, and specifically to electrically powered ceiling fan blades.

BACKGROUND OF THE INVENTION

Ceiling fans powered by electric motors have been used for years in circulating air. They typically have a motor within a housing mounted to a downrod that rotates a set of fan blades about the axis of the downrod. Their blades have traditionally been flat and oriented at an incline or pitch to present an angle of attack to the air mass in which they rotate. This causes air to be driven downwardly.

When a fan blade that extends generally radially from its axis of rotation is rotated, its tip end travels in a far longer path of travel than does its root end for any given time. Thus, its tip end travels much faster than its root end. To balance the load of wind resistance along the blades, and the air flow generated by their movement, fan blades have been designed with an angle of attack that diminishes towards the tip. This design feature is also conventional in the design of other rotating blades such as marine propellers and aircraft propellers.

In 1997 a study was conducted at the Florida Solar Energy Center on the efficiencies of several commercially available ceiling fans. This testing was reported in U.S. Pat. No. 6,039,541. It was found by the patentees that energy efficiency, i.e. air flow (CFM) per power consumption (watts), was increased with a fan blade design that had a twist in degrees at its root end that tapered uniformly down to a smaller twist or angle of attack at its tip end. For example, this applied to a 20-inch long blade (with tapered chord) that had a 26.7 degrees twist at its root and a 6.9 degrees twist at its tip.

SUMMARY OF THE INVENTION

In a preferred form of the invention a ceiling fan has a plurality of fan blades mounted for rotation about a fan axis of blade rotation with the blades having a greater angle of attack distal the fan axis than proximally the fan axis, and with the rate of change in angle of attack therebetween being non-uniform, the blade angle of attack increasing continuously from proximally the fan axis to distally the fan axis.

DETAILED DESCRIPTION

Figure 1:
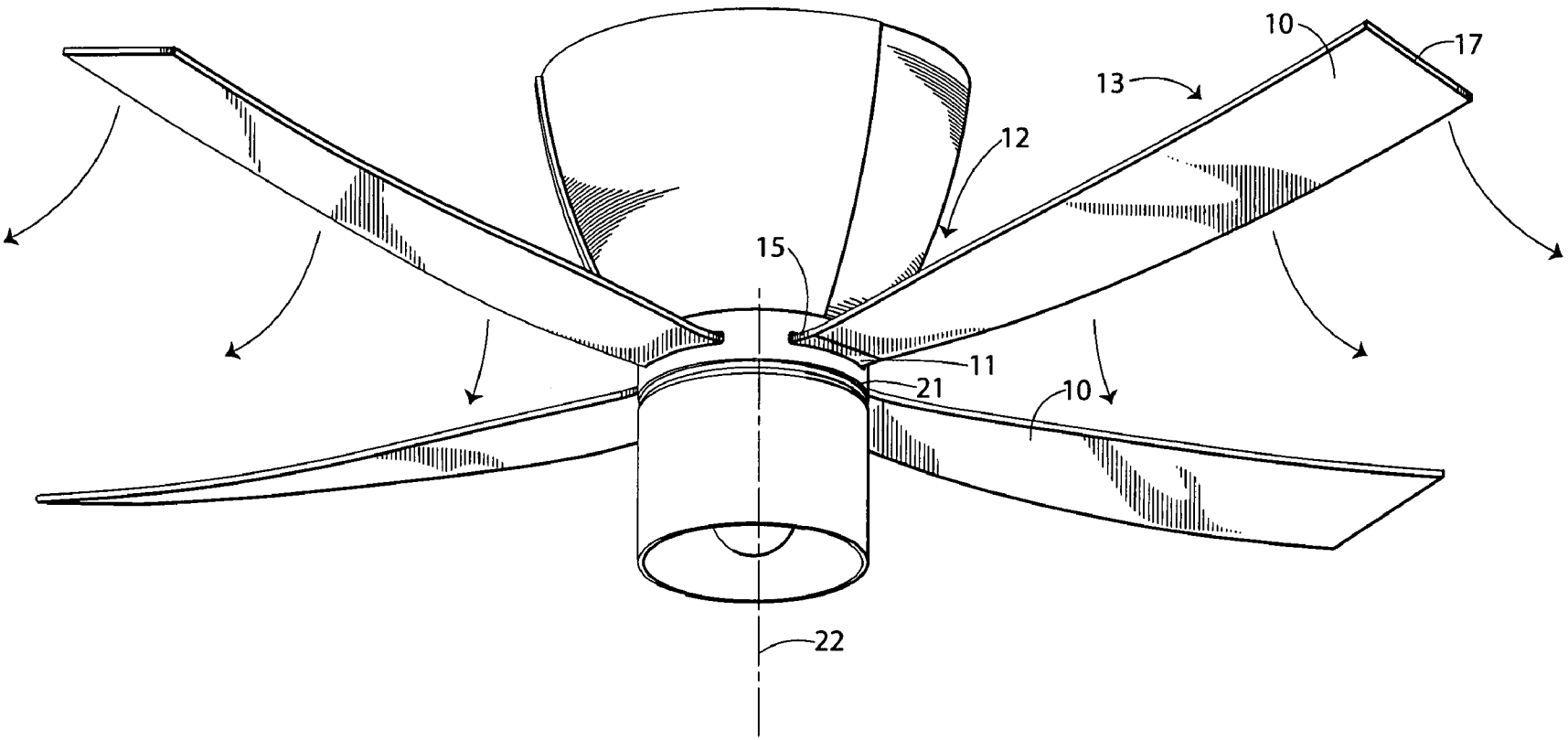
FIG. 1. is a perspective view of the ceiling fan blade in a preferred embodiment.
Figure 2:
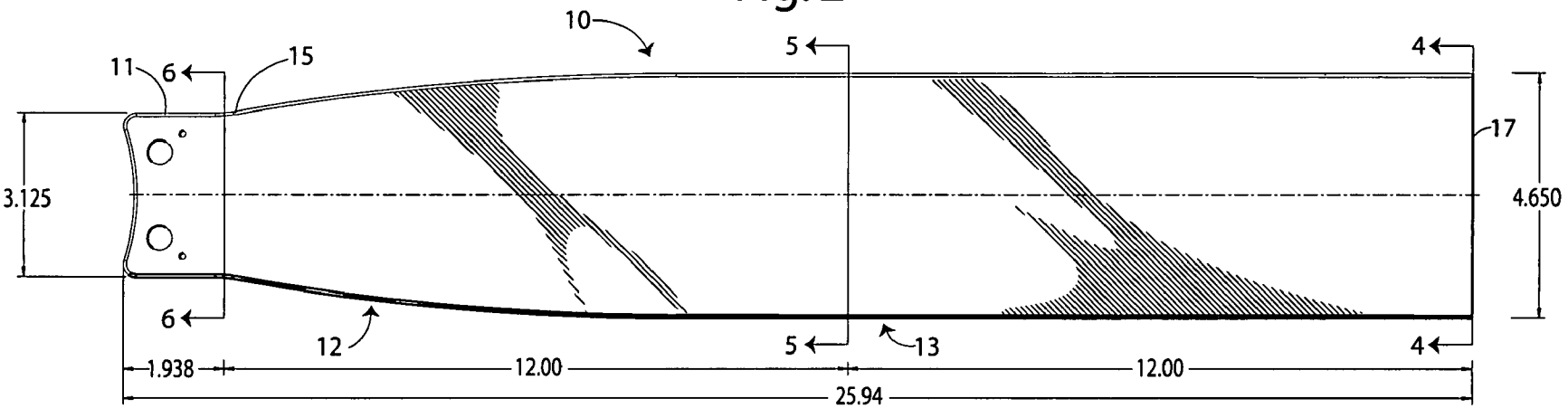
FIG. 2 is a side view of the ceiling fan blade of FIG. 1.
Figure 3:
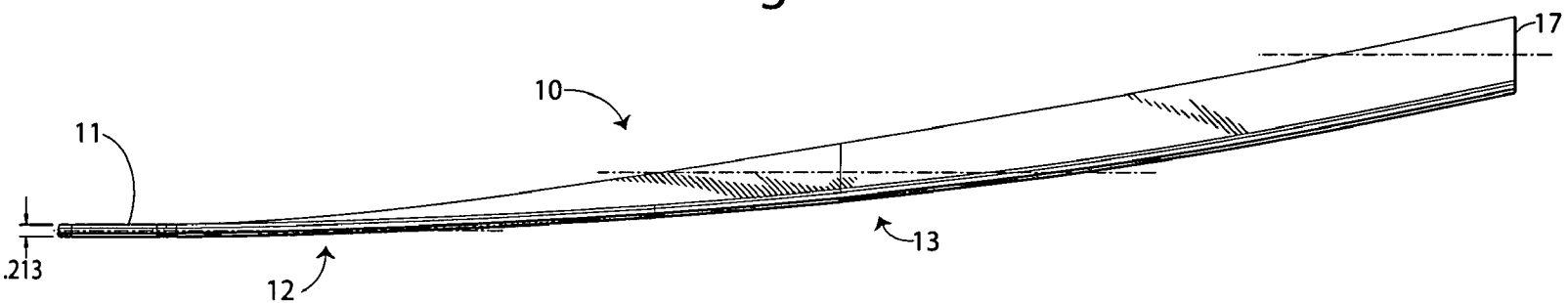
FIG. 3 is a top view of the ceiling fan blade of FIG. 1.
Figure 4:
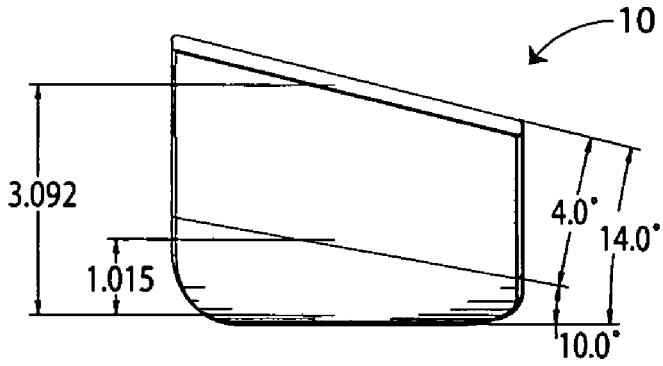
FIGS. 4-6 are a series of views of the ceiling fan blade of FIG. 1, FIGS. 4 and 5 being cross-sectional views.
Figure 5:
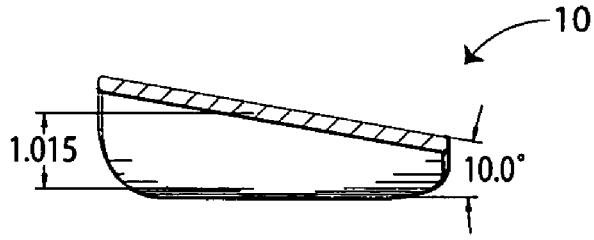
Figure 6:
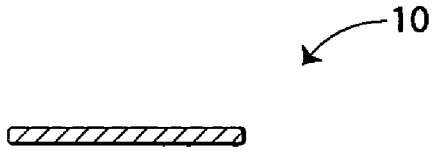

The fan blade technology disclosed in U.S. Pat. No. 6,039,541 followed the assumption that all air flow into the fan blades is from a direction that is perpendicular to the plane of rotation for the blades. In addition, it assumed that the airflow is of a constant velocity from the root end to the tip end of the blades as used in aircraft propeller theory. Using this assumption the blades were designed with a constant twist rate from root end to tip end.

Twisting of the blade is done in an attempt to optimize the relative angle of attack of the airflow direction relative to the blade surface. This is done to ensure that the blade is operating at its optimum angle of attack from root end to tip end. This angle changes to accommodate the fact that the tip of the blade moves faster than the root end of the blade diameter. This increase in velocity changes the direction of the relative wind over the blade.

Again, this assumption has now been found to be invalid for ceiling fans. Ceiling fans are air recirculating devices that do not move through air as an aircraft propeller does. Air does not move in the same vector or even velocity over their blades from root end to tip end.

Also, ceiling fans are designed in an attempt to provide an even airflow throughout a room rather than a concentrated column directly below the ceiling fan. The ceiling fans of the prior art do not accomplish this task.

With reference next to the drawings, there is shown a ceiling fan that is of conventional construction with the exception of the shape of its blades. The fan is seen to be mounted beneath a ceiling by a downrod that extends from the ceiling to a housing for an electric motor and switch box. Here the fan is also seen to have a light kit at its bottom. Power is provided to the motor that drives the blades by electrical conductors that extend through the downrod to a source of municipal power.

The fan blades are seen to be twisted rather than flat and to have a graduated dihedral. The dihedral is provided for a wider distribution of divergence of air in the space beneath the fan. Air flow to and from the fan blades is shown by the multiple lines with arrowheads.

With continued reference to the drawings, it is seen that the blade 10 is demarked to have three sections although the blade is, of course, of unitary construction. Here the 26-inch long blade 10 has three sections, a mounting section 11 and two airflow sections 12 and 13 of equal lengths, i.e. 12 inches each. The first airflow section 12 commences at a root end 15 while the second airflow section 13 terminates at a tip end 17. The two airflow sections 12 and 13 are twisted as is evident in the drawings. However, the rate of twist from the root end to the tip end is nonuniform. The twist or ratio of the degree increase in the angle of attack over each inch in length deceases from root end to the tip end. The angle of attach at the root end is 0 degrees while the angle of attack at the tip end is 14 degrees. This decrease, however, is at two different rates. In the first airflow section 12, the change in twist rate is 0.833 degrees per inch from the root end to the beginning of the second airflow section 13. For the second airflow section 13, the change in twist rate from the commencement to the tip end 17 is 0.333 degrees per inch. Of course there is a small transition between each section of negligible significance. Thus, there is an 10 degree difference in angle of attack from one end of the first airflow section 12 to its other (0.833 degrees per inch times 12 inches). For the second airflow section 13 there is about 4 degree difference (0.333 degrees per inch times 12 inches).

The blade is seen to have its mounting section 11 mounted to the fan motor rotor hub 21 with its tip end 17 located distally of the hub. The hub rotates about the axis of the downrod from the ceiling as shown in FIG. 1 which is substantially vertical. As most clearly noted by the blade centerline 22, the blade has a 0 degrees of dihedral at its root end 15. The fan blade here is continuously arched or curved from end to end so that its dihedral is continuously changing from end to end. As shown by the air flow distribution broken lines in FIG. 1 this serves to distribute air both directly under the fan as well as in the ambient air space that surrounds this space. Conversely, fans of the prior art have mostly directed the air downwardly beneath the fan with air flow in the surrounding space being indirect and weak. Though those fans that have had their blades inclined at a fixed dihedral throughout their length have solved this problem, such has been at the expense of diminished air flow directly under the fan.

The blade dihedral may increase continuously from end to end. However, it may be constant near its root end and/or near its tip with its arched or curved portion being along its remainder. Indeed, the most efficient design, referred to as the gull design, has a 0 degree dihedral from its root end to half way to its tip, and then a continuously increasing dihedral to its tip. In the preferred embodiment shown the blade root end 15 has a 0 degree dihedral. Fan size, power, height and application are all factors that may be considered in selecting specific dihedrals. Here, the first airflow portion has a dihedral that increases 1.015 inch over the course of the twelve inches of length of the section, this translates to a rise of approximately 0.08 inch per inch in length. The second airflow section 13 rises approximately 3.092 inch over the course of the twelve inches of length, thus translating to a rise of approximately 0.25 inches per inch in length.

While the preferred embodiment shows the rate of twist very specifically it should be understood that the rate may vary. In the preferred embodiment that blade angle of attack increases approximately 0.8 degrees per inch proximally the fan axis and approximately 0.3 degrees per inch distally said fan axis. The term approximately with reference to the degrees per inch may vary plus or minus 0.2 degrees per inch with reference to the preferred embodiment. Furthermore, it should be understood that the angle of attack and ratio of twist may vary further from the preferred embodiment, and that the invention encompasses the concept of a ceiling fan blade wherein the blade's angle of attack is greater distal the axis than proximal the axis.

It thus is seen that a ceiling fan now is provided which is substantially better at spreading the airflow throughout the room than those of the prior art. The fan may of course be used in other locations such as a table top. Although it has been shown and described in its preferred form, it should be understood that other modifications, additions or deletions may be made thereto without departure from the spirit and scope of the invention as set forth in the following claims.

The invention claimed is:

1. A ceiling fan having a plurality of fan blades mounted for rotation about a fan axis of blade rotation and with the blades having a greater angle of attack distal said fan axis than proximally said fan axis with the rate of change in angle of attack therebetween being non-uniform, the blade angle of attack increasing continuously from proximally said fan axis to distally said fan axis.

2. The ceiling fan of claim 1 wherein the blade angle of attack increases at a plurality of incrementally different rates from proximal said fan axis to distal said fan axis.

3. The high efficiency ceiling fan of claim 2 wherein the blade angle of attack increases approximately 0.8 degrees per inch proximally said fan axis and approximately 0.3 degrees per inch distally said fan axis.

4. The high efficiency ceiling fan of claim 3 wherein the blade angle of attack increases in two increments of fixed rates of substantially equal lengths as measured between root and tip ends.

5. The high efficiency ceiling fan of claim 1 wherein at least a portion of each blade is curved increasingly upwardly towards its tip end to have a continuous graduated dihedral.

6. A high efficiency ceiling fan having a plurality of fan blades mounted for rotation about a fan axis of blade rotation and with the blades being twisted as they extend from the fan axis at a twist rate that decreases non-uniformally from the blade root end to the blade tip end and wherein the blades twist at a plurality of fixed rates of decrease.

7. The high efficiency ceiling fan of claim 6 wherein the blades twist at two incrementally fixed rates of decrease.

8. The high efficiency ceiling fan of claim 7 wherein the blades twist in two increments of fixed rates of decrease of substantially equal lengths along the blade between root end and tip end.

9. The high efficiency ceiling fan of claim 6 wherein the blades have an angle of attack of approximately 14 degrees at their tip ends.

10. The high efficiency ceiling fan of claim 6 wherein at least a portion of each blade is curved increasingly upwardly towards its tip end to have a graduated dihedral.

11. A ceiling fan having a plurality of fan blades mounted for rotation about a generally vertical axis wherein each blade has a greater angle of attack distally said fan axis than proximally said fan axis with the rate of change in angle of attack therebetween being non-uniform, and with at least a portion of each blade being arched upwardly with continuously increased dihedral for enhanced air flow dispersion.

12. The ceiling fan of claim 11 wherein the blade angle of attack increases at a plurality of incrementally different rates from proximal said fan axis to distal said fan axis.

13. The high efficiency ceiling fan of claim 12 wherein the blade angle of attack increases approximately 0.8 degrees per inch proximally said fan axis and approximately 0.3 degrees per inch distally said fan axis.

14. The high efficiency ceiling fan of claim 13 wherein the blade angle of attack increases in two increments of fixed rates of substantially equal lengths as measured between root and tip ends.

15. The high efficiency ceiling fan of claim 11 wherein at least a portion of each blade is curved increasingly upwardly towards its tip end to have a continuous graduated dihedral.

16. A ceiling fan having a plurality of fan blades mounted for rotation about a fan axis of blade rotation and with the blades having a greater angle of attack distally said fan axis than proximally said fan axis.

17. The ceiling fan of claim 16 wherein the blade angle of attack increases at a plurality of incrementally different rates from proximal said fan axis to distal said fan axis.

* * * * *